US005600936A

United States Patent [19]

Moncrief et al.

[11] Patent Number: 5,600,936

[45] Date of Patent: Feb. 11, 1997

[54] SUSPENDED MODULAR PARTITION INSERTER

[76] Inventors: Frank Moncrief, 6310 Chadd's Pointe, Acworth, Ga. 30101; Dwight L. Smith, 1130 Kennesaw Springs Ct., Kennesaw, Ga. 30144; David R. Bacco, 1451 Larkwood Dr., Canton, Ga. 30114

[21] Appl. No.: 418,102

[22] Filed: Apr. 6, 1995

[51] Int. Cl.[6] ..... B65B 21/04; B65B 59/00

[52] U.S. Cl. ..... 53/263; 53/157; 493/91; 493/478

[58] Field of Search ..... 53/263, 157, 504, 53/48.1, 201; 493/479, 478, 91, 90, 92, 912

[56] References Cited

U.S. PATENT DOCUMENTS

| | | | |
|---|---|---|---|
| 2,710,565 | 6/1955 | Schroeder | 493/91 X |
| 2,864,212 | 12/1958 | Bruce | 493/91 X |
| 3,350,836 | 11/1967 | Dillon et al. | 53/157 X |
| 3,621,765 | 11/1971 | Sootheran et al. | 493/91 |
| 3,690,225 | 9/1972 | Monaco et al. | 493/90 X |
| 4,962,625 | 10/1990 | Johnson, Jr. et al. | 53/263 X |

*Primary Examiner*—James F. Coan
*Attorney, Agent, or Firm*—Hopkins & Thomas

[57] ABSTRACT

A packaging machine has a partition inserter and selecting apparatus suspended above a flow of articles. The partition inserter and selecting apparatus are mounted to an inner frame which can be raised or lowered to adjust the spacing between the partition inserter and selecting apparatus relative to the articles. In this manner, the packaging machine can package articles of different heights. The partition inserter and selecting apparatus are mounted to the inner frame on guide rails which allow a technician to move the partition inserter and selecting apparatus laterally away from the articles and over a maintenance deck so that the technician can easily perform necessary repairs or maintenance. The partition inserter and selecting apparatus are releasably engaged with each other to permit the technician to access more easily all areas of the partition inserter and selecting apparatus. The packaging machine preferably has three pairs of partition inserters and selecting apparatuses suspended over the flow of articles with the pairs staggered relative to each other so that each selecting apparatus places a partition between different rows of articles. Further, each pair of a partition inserter and selecting apparatus is accurately positioned at a desired location with a semiautomatic adjustment system.

42 Claims, 5 Drawing Sheets

SUSPENDED MODULAR PARTITION INSERTER

FIELD OF THE INVENTION

This invention generally relates to an apparatus for suspending partition inserters above a flow of articles. In another aspect, the invention relates to an adjustable support frame for partition inserters.

BACKGROUND OF THE INVENTION

In the course of packaging articles, such as bottles or cans, the articles are separated into discrete groups and are placed within a unitary container, such as a carton. Prior to placement of each discrete group of articles into a container, a partition or insert is often placed between the articles to prevent any damage from occurring to the articles or to the graphics on the articles. These partitions are frequently placed between bottles to prevent the bottles from colliding into each other.

The packaging machines comprise at least one partition feeder or inserter for placing the partitions in position between adjacent articles in a discrete group. The partition inserter typically forms a stack of the partitions in a supply hopper having two side walls and a bottom. One end of the supply hopper is open to permit an operator to add partitions to the stack as the partitions are being removed from the other end of the supply hopper. A set of tabs are located at the other end of the supply hopper to contact the end partition and to releasably hold the partitions within the supply hopper.

The packaging machines also typically have some type of selecting apparatus for removing the partitions from the tabs and for placing each partition in a discrete group of articles. The selecting apparatus usually has a set of vacuum cups that move over and contact an end partition and then move away from the partition inserter in order to remove the end partition against contact with the tabs. The removed partition is then dropped down in a timed relationship to the flow of articles so that the partition is placed in a proper position between the articles in a discrete group.

The packaging machines must have the partition inserter and selecting apparatus precisely located relative to the flow of articles in order for the partitions to be accurately and reliably placed within each discrete group. To assist in the placement of the partitions, wedges or other type of separators are commonly placed in the article flow to move adjacent articles apart for the partitions. The partition inserter and selecting apparatus are positioned along the article flow relative to the wedges so that the partitions are inserted into the discrete groups when the articles are separated from each other. The partition inserter and selecting apparatus must also be at a certain distance above the articles, with this distance being determined based upon the height of the articles, the speed at which articles are moved downstream, and the speed at which the partitions leave the selecting apparatus. The partition inserter and selecting apparatus are fixed in their locations to ensure the consistent and reliable placement of the partitions.

While the fixed locations of the partition inserter and selecting apparatus ensure consistent and reliable operation, the fixed locations prevent the packaging machine from being able to package articles of different sizes into various product configurations. The packaging machines are unable to package articles of different widths or configurations since this would affect the placement of the wedges. The packaging machines are unable to package articles of different heights since this would change the placement of the selecting apparatus above the articles. It was therefore a problem in the industry to consistently and reliably deliver partitions while permitting the packaging machine to package articles of different sizes and of different configurations.

It was also difficult to repair or to perform maintenance on the existing partition inserters and selecting apparatuses. In order for a technician to access the partition inserter or selecting apparatus, the technician would have to climb on top of the conveyor that directs the articles in the downstream direction. The conveyor, however, would have various components, such as flight bars for forming groups of articles, mounted to its surface which would make it difficult for the technician to stand or kneel on the conveyor.

In addition to the difficulty in reaching the partition inserter or selecting apparatus, it was also difficult for a technician to access certain areas on the partition inserter or the selecting apparatus. To maximize the speed of the selecting apparatus, the selecting apparatus has its vacuum cups positioned close to the end of the stack to minimize the distance that the vacuum cups must travel. The selecting apparatus, as well as the partition inserter, are also mounted close to the top of the articles to reduce the distance that the partitions have to travel before being placed between the articles. In view of the close placement of the selecting apparatus to both the partition inserter and to the tops of the articles, many areas of the partition feeder and selecting apparatus are difficult to access for necessary repairs or maintenance. Furthermore, the portions below the selecting apparatus and partition feeder, such as a carton assembly, are difficult to reach when a jam or other difficulty occurs. As a result, the down time required to perform the repairs or maintenance is relatively long reducing the overall efficiency of the packaging machine.

SUMMARY OF THE INVENTION

The invention, in one aspect, comprises a frame for suspending a partition inserter or selecting apparatus above a flow of articles. The frame has a plurality of vertical supports which rest upon a respective plurality of levers. The levers are coupled together so that the rotation of one lever will cause a corresponding rotation in all of the other levers. A controller rotates the levers an amount and in a direction so that the frame positions the partition inserter or selecting apparatus at a desired location.

The invention, in a second aspect, comprises an adjustable support frame which permits a selecting apparatus or partition inserter to slide along the width of an article conveyor. The partition inserter or selecting apparatus can therefore be positioned according to the article size or article configuration.

In the preferred embodiment, the frame has a maintenance platform at one end so that the partition inserter or selecting apparatus can be slid over the platform for necessary repairs or maintenance. The selecting apparatus and partition inserter are releasably engaged with each other so that the repairs or maintenance can be easily performed on only one of the units. The partition inserter and selecting apparatus are also releasably engaged with a positioning system which selectively positions the selecting apparatus and partition inserter at a desired location relative to a flow of articles.

DETAILED DESCRIPTION OF THE PREFERRED EMBODIMENT

Figure 1:
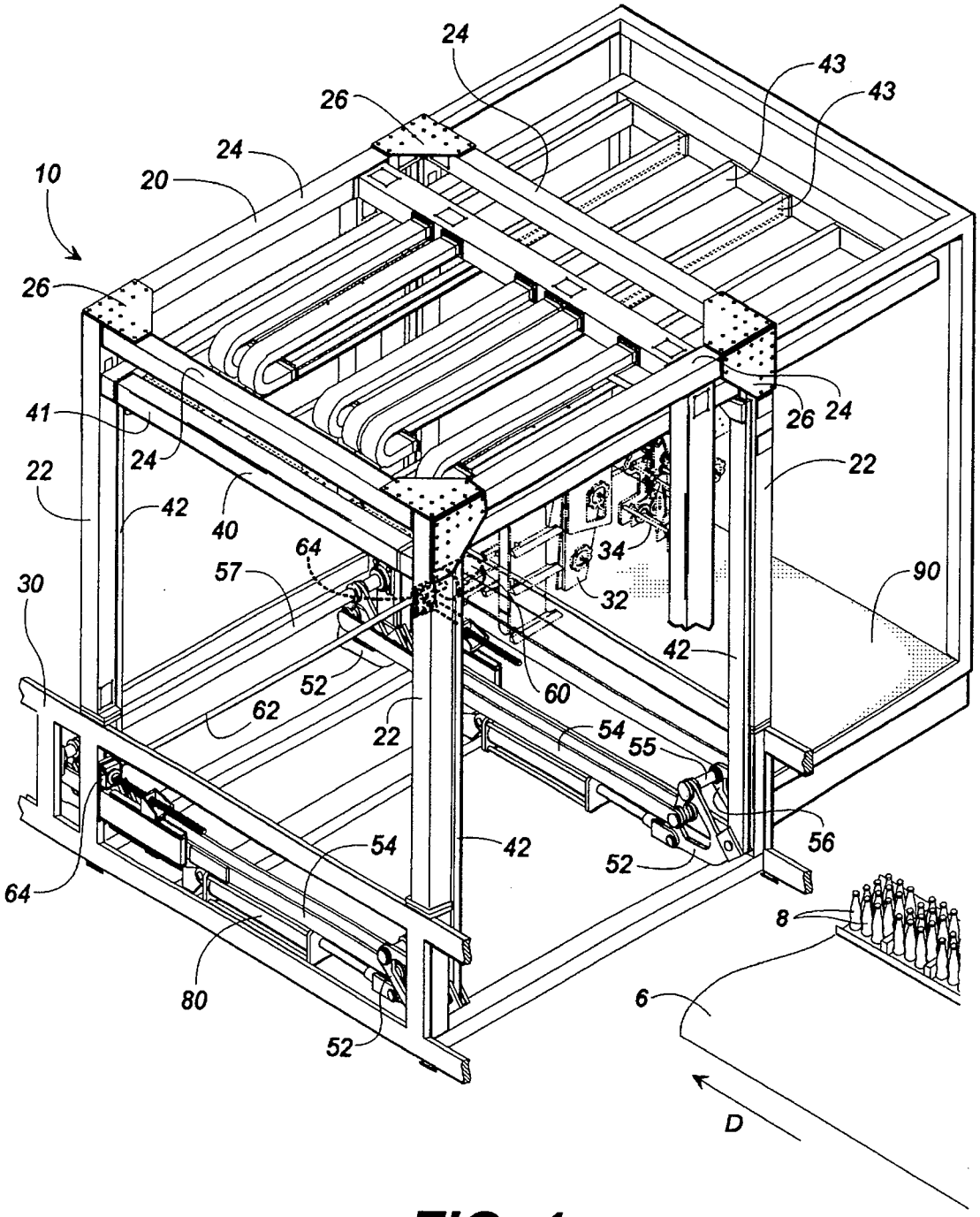
FIG. 1 is a perspective view of a frame for suspending partition inserters and selecting apparatuses above a flow of articles.

With reference to FIG. 1, a partition lift frame 10 according to a preferred embodiment of the invention comprises an outer frame 20 mounted onto a main frame 30 of a packaging machine and, more precisely, to the infeed section of the main frame 30. The outer frame 20 has four vertical support structures 22 which are mounted to the infeed section of the main frame 30 and have their tops interconnected with four beams 24. The outer frame 20 must be capable of supporting a large weight and, consequently, the support structures 22 and beams 24 are formed of a high strength material, which is preferably steel. A set of mounting plates 26 are bolted between the support structures 22 and the beams 24 in order to securely fasten the two members together.

A set of three partition inserters 32 and selecting apparatuses 34 are mounted onto an inner frame 40 with only one set of a partition inserter 32 and selecting apparatus 34 being shown. While three sets have been shown, it should be understood that a packaging machine may have a greater or lesser number of partition inserters 32 and selecting apparatuses 34. The partition inserter 32 is preferably a mass feeder disclosed in commonly assigned U.S. patent application Ser. No. 08/418,100, filed on Apr. 6, 1995, entitled "Mass Feeder For Product Delivery System," and the selecting apparatus 34 is preferable the selecting apparatus disclosed in commonly assigned U.S. patent application Ser. No. 08/418,101, filed on Apr. 6, 1995, entitled "Article Selection and Delivery Method and Apparatus." The invention, however, is not limited to these particular partition inserters or selecting apparatuses but may be constructed with other types of partition inserters or selecting apparatuses.

The partition feeder 32 forms a stack of partitions between a pair of side rails and has a set of tabs at one end of the stack. The selecting apparatus 34 removes a single partition from the partition feeder 32 and knocks out portions of the partition to form an insert having a main wall and two smaller transverse walls. The main wall is for separating two adjacent rows of articles and two smaller transverse walls are for separating the three articles in each row.

As a possible mode of operation for the partition feeders 32 and selecting apparatuses 34, the packaging machine may be packaging articles 8, which are bottles, into twelve packs with the articles 8 being arranged in discrete groups having four rows and three columns of articles 8. The first selecting apparatus 34 will place a partition between the first two rows of articles 8, the second selecting apparatus 34 will next place a partition between the second and third rows of articles 8, and the third selecting apparatus 34 will place a partition between the third and fourth rows of articles 8. The pairs of partition inserters 32 and selecting apparatuses 34 are therefore staggered in a direction transverse to the article flow D so that the partitions can be placed between the different rows of articles 8 in each discrete group.

The inner frame 40 is comprised of a generally planar top rack portion 41 and four vertical support structures 42. Since the inner frame 40 must also be capable of supporting a large weight, the support structures 42 and rack portion 41 are comprised of a high strength material, which is preferably steel beams. The support structures 42 of the inner frame 40 engage the support structures 22 of the outer frame 20. More precisely, the support structures 22 of the outer frame 20 have linear guides formed along their lengths and the support structures 42 of the inner frame 40 have bearings for engaging the linear guides. In this manner, the inner frame 40 can slide up or down along the outer frame 20.

Figure 2:
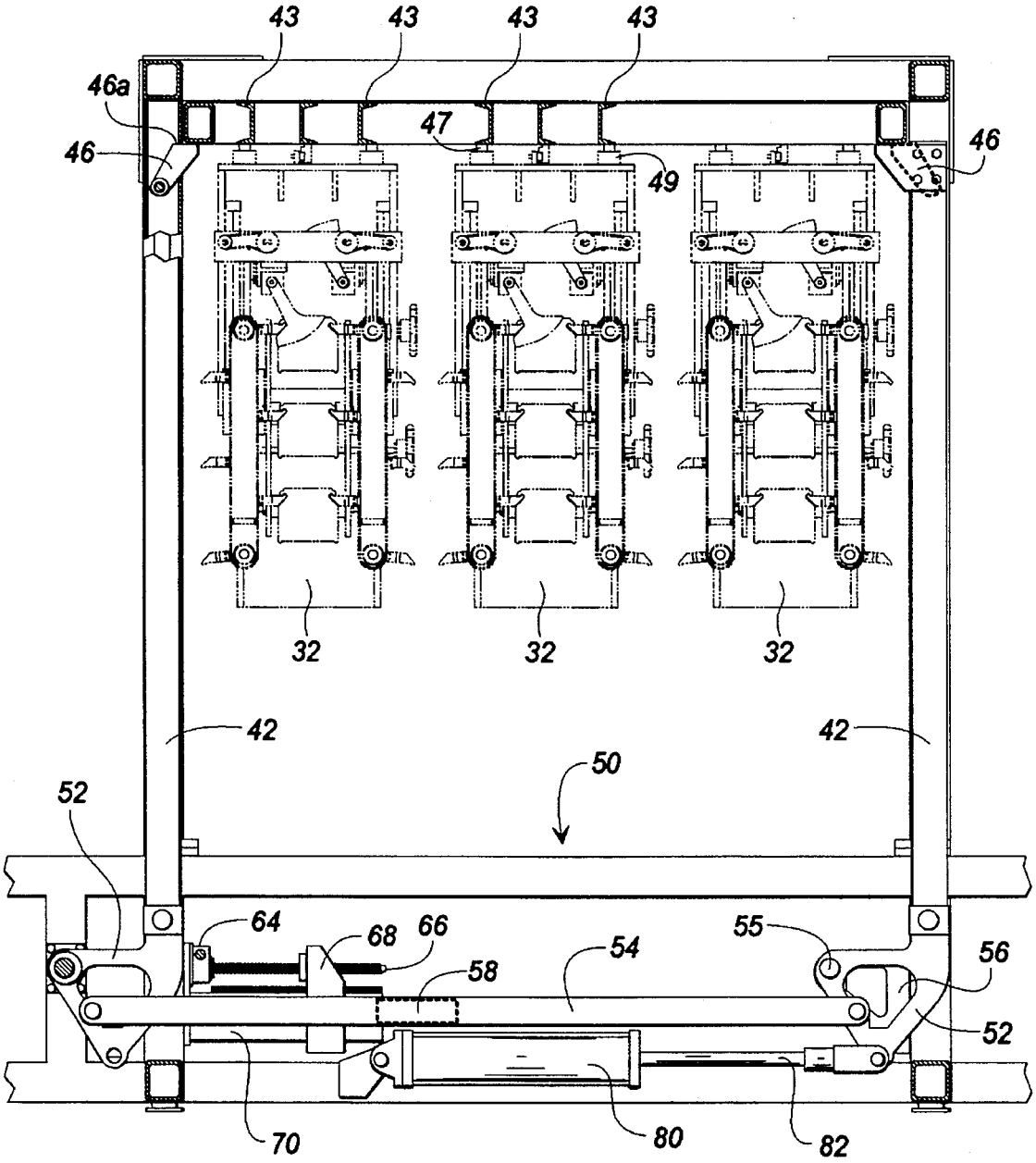
FIG. 2 is an end view of a partition lift frame placing the partition inserters in a raised position.

The outer frame 20 has a retractable tab 46 which is located near the top of each support structure 22. Each of the tabs 46 is a pneumatically controlled single acting cylinder with a spring return. In their extended position, the tabs 46 have a planar surface **46*a* upon which the inner frame 40 may be supported, as illustrated in FIG. 2. To lower the inner frame 40, the inner frame 40 is raised a slight distance and the tabs 46 are retracted with an air cylinder (not shown). With the tabs 46 retracted, the inner frame 40** may be positioned to any desired vertical position.

To adjust the vertical position of the inner frame 40, each of the inner frame's support structures 42 is fastened at its lower end to a lift assembly 50. Since the lift assembly 50 and inner frame 40 have similar structures on both sides of an article conveyor 6, the description of the lift assembly 50 and inner frame 40 will focus on only one side of the conveyor 6.

The lower ends of support structures 42 for the inner frame 40 are attached to levers 52 in the lift assembly 50. A first mechanical link 54 couples the two levers 52 on one side of the article conveyor 6 and a second mechanical link 58 couples the levers 52 on the other side of the article conveyor 6. Due to the mechanical links 54 and to the identical shape of the levers 52, the levers 52 on the same side of the article conveyor 6 will pivot in synchronism with each other.

The levers 52 on opposite sides of the article conveyor 6 will also pivot in synchronism with each other. The two levers 52 on the upstream side of the article conveyor 6 are connected to the main frame 30 of the packaging machine through a lever mounting bracket 56. These upstream levers 52 pivot about a shaft 55 joining the lever mounting bracket 56 to the levers 52. The levers 52 on the downstream side of the article conveyor 6 are mounted to the main frame 30 through a synchronous shaft 57 and bearings. These downstream levers 52 are keyed to the synchronous shaft 57 so that the rotation of one lever 52 will cause an identical rotation in the other lever 52. As a result of the synchronous shaft 57 linking the levers 52 on opposite sides of the article conveyor 6 and the mechanical links 54 coupling the levers 52 on the same side of the article conveyor 6, all four levers 52 pivot in synchronism with each other.

As best seen in FIG. 1, a motor 60 is connected to one end of a drive shaft 62 extending along the width of the conveyor 6o A reduction gear assembly 64 is attached to the drive shaft 62 near each end of the drive shaft 62 and rotates its screw shaft 66 based upon the rotation of the drive shaft 62. The reduction gear assemblies 64 are preferably a reduction gear assembly manufactured by Action Jack which rotates its screw shaft 66 a fraction of the amount that the drive shaft 62 is rotated.

Figure 3:
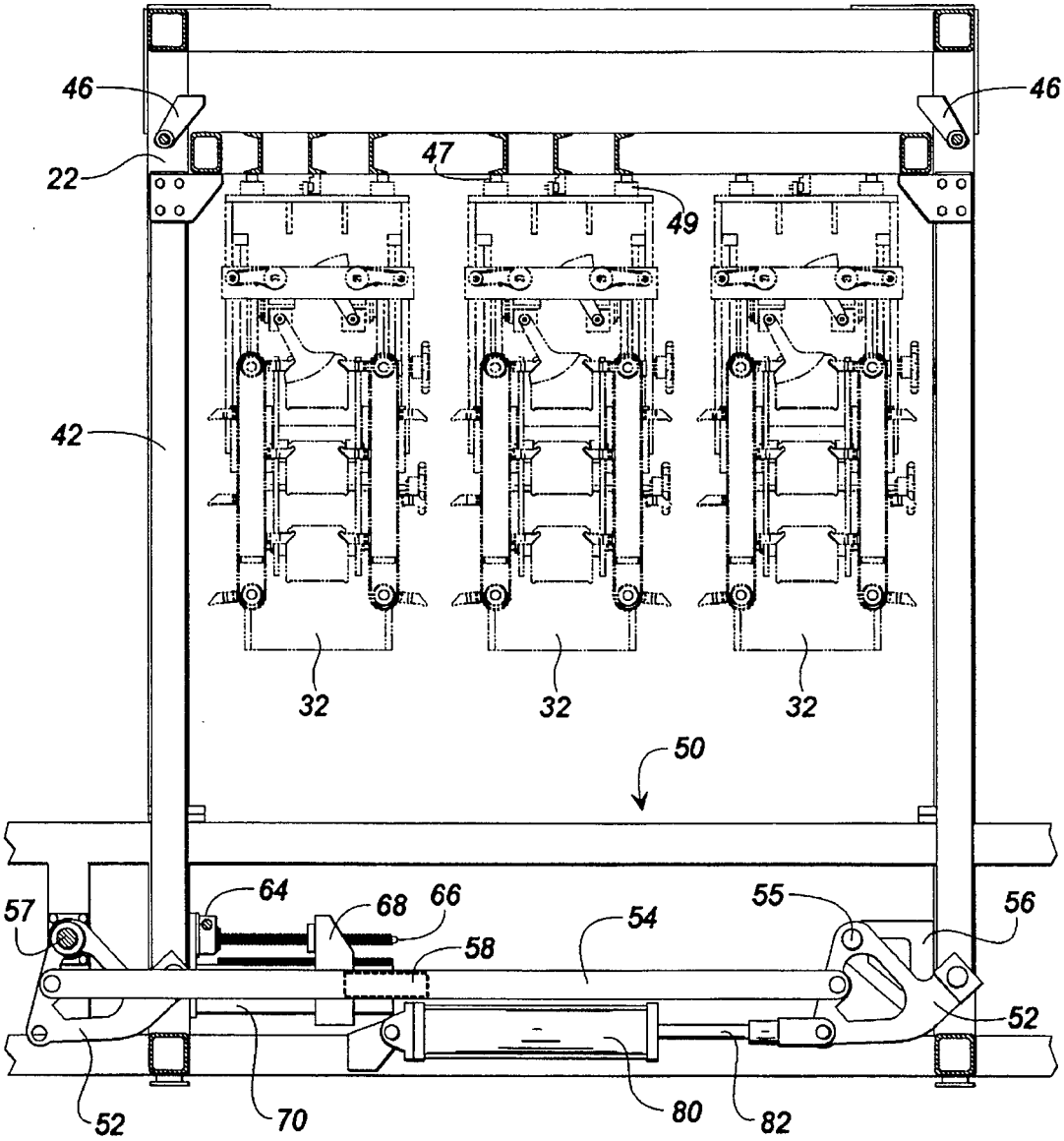
FIG. 3 an end view of the partition lift frame placing the partition inserters in a lowered position.

With reference to FIGS. 2 and 3, a mechanical stop 68 has a nut portion which is threaded onto the screw shaft 66 and has bearings which engage a linear guide 70 mounted to the main frame 30 and extending below the length of the screw shaft 66. The mechanical stop 68 travels along the screw shaft 66 upon rotation of the screw shaft 66 with the direction in which the mechanical stop 68 travels being determined by the direction in which the screw shaft 66 rotates. As best shown in FIG. 3, when the inner frame 40 is not resting on the tabs 46, the weight of the inner frame 40 rotates the levers 52 in clockwise direction until a stop tab 58 projecting from a side surface of each mechanical link 54 engages the mechanical stop 68.

To position the inner frame 40 at a desired height, the motor 60 rotates the drive shaft 62 a certain amount in a certain direction. The motor 60 may be driven by any suitable controller, with the preferred controller being a programmable logic controller (PLC). The rotation of the drive shaft 62 is translated by the gear assembly 64 into a rotation of the screw shaft 66 which, consequently, moves the stop 68 along the length of the screw shaft 66. The links 54 are moved along with the stop tab 58 by the action of the stop 68 and the levers 52 are permitted to rotate to either raise or lower the inner frame 40. The amount and direction in which the motor 60 needs to be driven to place the inner frame 40 at a desired position can be determined by one skilled in the art and will not be discussed in further detail.

The motor 60 is preferably a variable speed motor to permit coarse and fine positioning of the inner frame 40. By driving the motor 60 at a higher speed, the inner frame 40 can be quickly raised or lowered. The inner frame 40 might have to be raised quickly during a clean out operation when a carton becomes jammed while traveling in a carton transport assembly formed below the partition feeders 32. When the motor 60 is driven at the low speed, the inner frame 40 can be accurately positioned at a desired height above the articles 8. Consequently, the partition inserters 32 and selecting apparatuses 34 can be easily positioned for different article heights.

While the motor 60 is the preferred device for performing the coarse adjustment, a pneumatically or hydraulically controlled cylinder 80 can be used to quickly raise or lower the inner frame 40. The cylinder 80 would be placed on both sides of the conveyor 6 and would have an end of its piston rod 82 connected to a lever 52, such as upstream levers 52. The cylinder 80 would be securely mounted to the main frame 30 of the packaging machine. Thus, by fully extending the piston rod 82, the levers 52 would be rotated in a counter-clockwise direction until the inner frame 40 is raised to the top of the outer frame 20. The inner frame 40 can then be lowered by releasing air or hydraulic pressure until the inner frame 40 is approximately positioned at the desired location.

The top rack portion 41 of the inner frame 40 has a number of transverse beams 43 running across the width of the article conveyor 6 and the partition inserters 32 and selecting apparatuses 34 have bearings 49 which engage linear guides 47 on the transverse beams 43. In the embodiment shown, each partition inserter 32 and selecting apparatus 34 is mounted to a pair of spaced transverse beams 43 having linear guides 47. The partition inserters 32 and selecting apparatuses 34 can therefore be positioned at any desired location along the width of the inner frame 40.

During operation of the packaging machine, as discussed above, the pairs of partition inserters 32 and selecting apparatuses 34 are staggered along the width of the article conveyor 6 so that the partitions are placed between different rows of articles 8. A packaging machine with the inner frame 40, partition inserters 32, and selecting apparatuses 34 can package articles 8 of different sizes and different configurations by simply sliding the partition inserters 32 and selecting apparatuses 34 to an appropriate location relative to the flow of articles 8.

The inner frame 40 offers other advantages as well. For instance, the beams 43 having the linear guides 47 in the inner frame 40 extend beyond the vertical supports 22 of the outer frame 20 on one side of the article conveyor 6. A maintenance platform 90 is located on that side of the article conveyor 6 below the extended section of the inner frame 40. When a technician needs to repair or to perform maintenance on a partition inserter 32 or a selecting apparatus 34, the technician slides the unit 32 or 34 over the maintenance platform 90. Since the technician no longer needs to stand or work over the article conveyor 6, the necessary maintenance and repairs on the partition inserter 32 and selecting apparatus 34 are performed in an easy and convenient manner.

Figure 5:
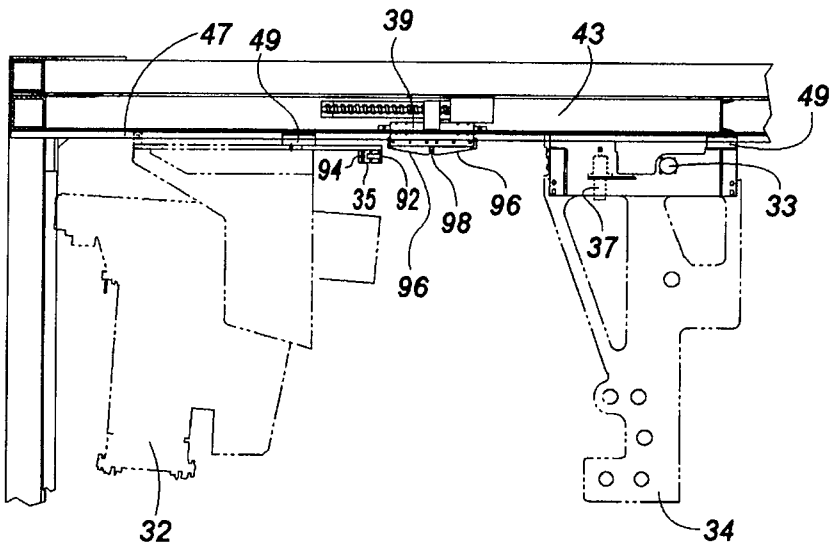
FIG. 5 is a side view of the partition lift frame showing the partition inserter separated from the selecting apparatus.
Figure 4:
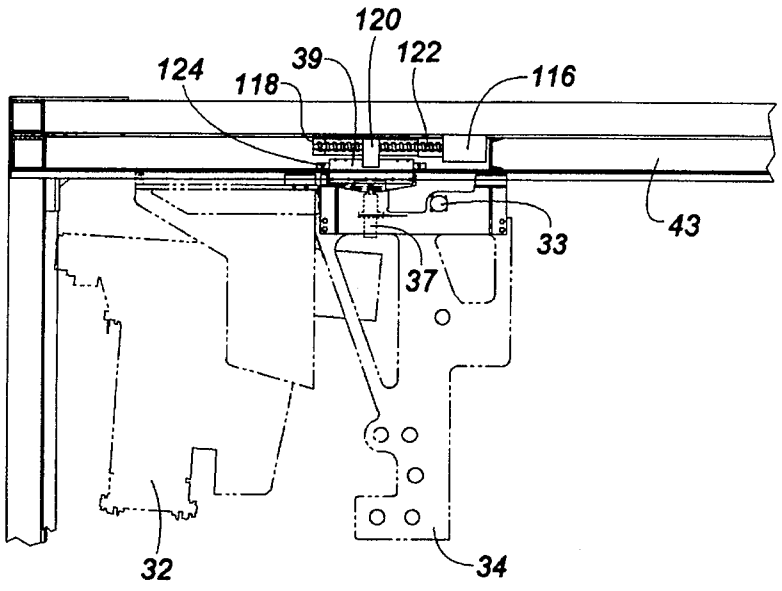
FIG. 4 is a side view of the partition lift frame showing the partition inserter attached to the selecting apparatus.

The maintenance and repairs are also performed easier with the invention since the partition inserter 32 and selecting apparatus 34 can be separated from each other and moved independently of each other. With reference to FIGS. 4 and 5, each selecting apparatus 34 is formed with a horizontally extending spring biased plunger 33 and each partition inserter 32 is formed with a locking cam plate 35. As shown in their separated state in FIG. 5, the locking cam plate 35 has a ramped surface 92 followed by an aperture 94. When the selecting apparatus 34 is moved toward the partition inserter 32, the plunger 33 rides up the ramped surface 92 of the locking cam plate 35. When the plunger 33 reaches the aperture 94 in the locking cam plate 35, the plunger 33 is pushed outwardly by the spring to lock the selecting apparatus 32 to the partition inserter 32.

A vertical plunger 37 locks the selecting apparatus 34 to a cam plate 39. The cam plate 39 has ramped surfaces 96 for depressing the plunger 37 as the selecting apparatus 34 is slid into a locked position, which occurs when the plunger 37 is extended into an aperture 98 in the cam plate 39. Since the ramped surfaces 96 are on either side of the cam plate 39, the selecting apparatus 34 may be moved to either side of the cam plate 39. Also, since the selecting apparatus 34 locks to the partition inserter 32, the partition inserter 32 and the selecting apparatus 34 may be locked into position onto the cam plate 39 and thus onto the inner frame 40.

The vertical plunger 37 and the horizontal plunger 33 are preferably comprised of a plunger unit attached to an end of piston rod in a cylinder. The cylinder is a "Festo" brand cylinder and a spring biases the plunger unit and piston rod to an extended position. The cylinder is pneumatically controlled and retracts the plunger unit and piston rod from an outer housing in order to release the plungers 33 or 37 from cam plates 35 and 39, respectively. The plungers 33 and 37 may be formed in various other ways which will be apparent to those skilled in the art.

The position of the selecting apparatus 34 and the partition inserter 32 may be adjusted to thereby adjust the location where the partitions are inserted relative to the flow of articles 8. The positioning of the selecting apparatus 34 and partition inserter 32 are adjusted by moving the cam plate 39 along the length of the beams 43. Each cam plate 39 slides along a linear guide 124 mounted to a side of one of the beams 43. The cam plate 39 is also mounted to a ball screw 122 through a bracket 120. The bracket 120 moves along its own linear guide 118 mounted to beam 43 and is moved in a direction determined by the rotation of the ball screw 122. The ball screw 122, in turn, is driven by a motor 116, which is preferably a stepper motor.

Thus, by controlling the motor 116, the cam plate 39 and the attached selecting apparatus 34 and partition inserter 32 may be selectively positioned at any location along the length of the linear guide 124. In the preferred mode of operation, the motors 116 will position the selecting apparatuses 34 and partition inserters 32 so that the partitions are placed between each row of articles. The selecting apparatuses 34 and partition inserters 32, however, may be placed at other locations without departing from the scope of the invention. Further, the length of the linear guide 124 may be varied to suit the particular needs of a packaging machine and is not limited to the dimensions shown.

Figure 6:
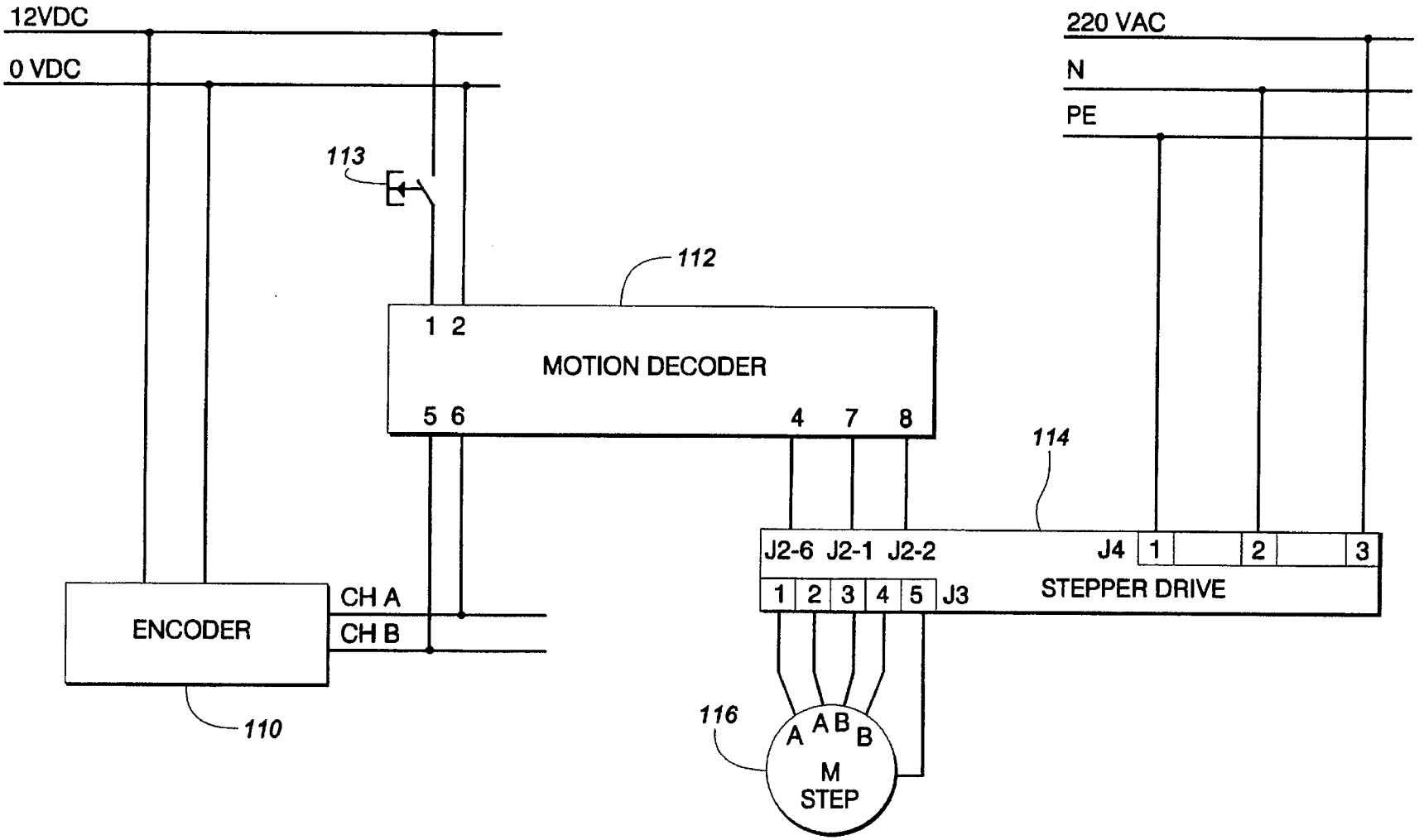
FIG. 6 is a schematic diagram of a semi-automatic adjustment system for each partition inserter and selecting apparatus.

A preferred circuit for manually adjusting the positions of one selecting apparatus 34 and partition inserter 32 is shown in FIG. 6. An operator or technician will rotate a control knob attached to a shaft of the encoder 110. Upon rotation of the knob, the encoder 110 generates a first pulsed signal on channel A and a second pulsed signal on channel B. From the phasing of the signals on channels A and B, a motion decoder 112 determines the direction of rotation, and thus the direction in which the cam plate 39 must be moved. The motion decoder 112 also determines the magnitude of the change in position by counting the number of pulses on the two channels A and B. The direction and amount of change in position is relayed to a stepper drive 114. The stepper drive 114 then controls the stepper motor 116 to rotate the ball screw 122 in a direction and in an amount necessary to place its associated cam plate 39 at the position indicated by the operator through the encoder 110.

While the circuitry for adjusting only one selecting apparatus 34 has been shown, it should be understood that each cam plate 39 for a selecting apparatus 34 in the packaging machine has a corresponding motion decoder 112 which receives the signals from the encoder 110. Also, each cam plate 39 and selecting apparatus 34 will have a corresponding stepper drive 114 and stepper motor 116.

In order for an operator to identify which cam plate 39 or selecting apparatus 34 needs to be positioned, the operator depresses a switch 113 for supplying operating power to an associated motion decoder 112. While all of the motion decoders 112 continuously receive the signals from the encoder 110, only those decoders 112 which have their associated switches 113 closed will be energized to control their stepper motors 116. An operator can depress more than one switch 113 in order to simultaneously control the positions of more than one cam plate 39 with the encoder 110.

The control circuit shown in FIG. 6 can accurately position the selecting apparatus 34 and partition inserter 32 to within 1/32 of an inch in accuracy. Thus, the selecting apparatus 34 can be accurately and easily repositioned for another size article or for another article configuration by simply rotating the shaft of the encoder 110.

In addition to the manual control of the positioning, the cam plates 39 and selecting apparatuses 34 may be automatically controlled. A PLC may have its output directly connected to the stepper drive 114 for controlling the direction and amount in which the stepper motor 116 is energized. The PLC may automatically place the selecting apparatuses 34 at a desired set of positions for various reasons, such as when an indication is made to the PLC that the packaging machine is changing over to a different article size or configuration.

It should be understood that the invention is not limited to the embodiment shown. The inner frame 40 and outer frame 20 may comprise a greater or lesser number of vertical support structures 22 and 42. The inner frame 40 and outer frame 20 may also have top portions formed in shapes other than a rectangle. Further, the adjustable inner frame 40 can be mounted to the outer frame 20 in other ways or may not be mounted at all to an outer frame 20. The beams 43 in the inner frame 40 may be longer or shorter than that illustrated and may be supported with an additional set of supports 22 near the platform 90.

Moreover, the inner frame 20 may be attached to a different type of lift mechanism 50. For instance, the inner frame 40 may be mounted to a jack-type assembly for raising and lowering the inner frame 40. The lift mechanism 50 is not limited to the shape of the levers 52 or in the manner in which the rotation of the levers 52 is controlled.

The invention may releasably lock the partition inserter 32 to the selecting apparatus 34 and the selecting apparatus 34 to the inner frame 40 in ways other than that described. For instance, the respective placements of the plungers 33 and 37 and cam plates 35 and 39 may be reversed. Also, instead of the plungers 33 and 37 and cam plates 35 and 39, the invention may have other types of releasable locks, such as manually activated locks.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

What is claimed is:

1. A lift frame for adjusting a vertical position of a partition inserter in a packaging machine relative to a flow of articles travelling in a downstream direction, comprising:

means for mounting a partition inserter above said flow of articles;

a plurality of vertical support members having one end attached to said mounting means and an opposite end attached to a lift assembly; and said lift assembly for adjusting a vertical position of the opposite ends of said vertical support members;

wherein said lift assembly also adjusts a vertical position of said mounting means and the vertical position of said partition inserter, whereby said vertical position of said partition inserter may be adjusted to correspond to a height of said articles.

2. The lift frame as set forth in claim 1, wherein said mounting means comprises a generally planar rack portion.

3. The lift frame as set forth in claim 2, wherein said rack portion has two beams extended perpendicular to the flow of articles and said partition inserter has bearings for being mounted to linear guides on said two beams whereby said partition inserter can be moved perpendicular to the flow of articles.

4. The lift frame as set forth in claim 1, wherein said support members comprise steel beams.

5. The lift frame as set forth in claim 1, wherein said lift assembly comprises a plurality of levers mounted to the opposite ends of the support members and means for adjusting an amount the levers rotate to thereby adjust the vertical position of said partition inserter.

6. The lift frame as set forth in claim 5, further comprising a first link coupling the levers on one side of the flow of articles, a second link coupling the levers on the opposite side of the flow of articles as the one side, and a synchronous shaft joining two levers on opposite sides of the flow of articles, said first and second links and said synchronous shaft causing said levers to rotate in synchronism with each other.

7. The lift frame as set forth in claim 6, wherein said adjusting means comprises a first stop tab located on said first link, a second stop tab located on said second link, a first stop member received on a first ball screw for contacting said first stop tab, a second stop member received on a second ball screw for contacting said second stop tab, and means for rotating said first and second ball screws to move said first and second stop members along a length of said first and second ball screws.

8. The lift frame as set forth in claim 7, wherein said rotating means comprises a motor for driving a shaft, a first gear assembly for driving said first ball screw at a fraction of a rate said drive shaft is rotated, and a second gear assembly for driving said second ball screw at said fraction of said rate said drive shaft is rotated.

9. The lift frame as set forth in claim 8, wherein said motor comprises a variable speed motor and is operated at a relatively high speed for quickly raising or lowering said partition inserter and is operated at a relatively low speed for slowly raising or lowering said partition inserter and for accurately adjusting said vertical position of said partition inserter.

10. The lift frame as set forth in claim 1, wherein each of said support members has linear bearings for engaging a linear guide on an outer support member whereby said support members slide along the outer support members.

11. The lift frame as set forth in claim 10, wherein an upper end of each of said outer support members has a retractable tab for supporting said mounting means when said tabs are extended.

12. A frame for adjustably mounting a partition inserter relative to a flow of articles in a packaging machine, comprising:

a generally planar rack portion having a plurality of beams extended perpendicular to the flow of articles;

a linear guide mounted to at least one of said beams;

bearings on said partition inserter for movably mounting said partition inserter to said linear guide;

the lateral position of said partition inserter relative to said flow of articles being adjusted by movement of said partition inserter along said linear guide; and means for adjusting the vertical position of said planar rack portion for corresponding vertical adjustment of said partition inserter relative to the flow of articles.

13. The frame as set forth in claim 12, further comprising a raised platform formed along one side of the flow of articles and underneath said one beam, wherein said partition inserter can be slid over said platform.

14. The frame as set forth in claim 12, further comprising a second partition inserter having bearings for mounting said second partition inserter to a linear guide on at least a second beam, said second beam being adjacent to said first beam whereby said second partition inserter is adjacent to said first partition inserter.

15. The frame as set forth in claim 14, further comprising a third partition inserter having bearings for mounting said third partition inserter to a linear guide on at least a third beam, said third beam being adjacent to said second beam whereby said third partition inserter is adjacent to said second partition inserter.

16. The frame as set forth in claim 12, wherein said partition inserter has bearings for mounting said partition inserter to at least a pair of adjacent beams.

17. The frame as set forth in claim 12, further comprising means for releasably engaging said partition inserter to said one beam and means for positioning said engaging means along said one beam and for thereby positioning said partition inserter along said one beam when said partition inserter is engaged with said engaging means.

18. The frame as set forth in claim 12, wherein said partition inserter comprises a partition feeder for holding a stack of partitions and a selecting apparatus for removing a single partition from the partition feeder and for placing said single partition between a group of said articles, said partition feeder and said selecting apparatus both having bearings for respectively mounting said partition feeder and said selecting apparatus to said one beam.

19. The frame as set forth in claim 18, further comprising means for releasably engaging said partition feeder to said selecting apparatus, wherein when said partition feeder is released from said selecting apparatus, said partition feeder and said selecting apparatus can be moved independently of each other along said one beam.

20. The frame as set forth in claim 19, wherein said engaging means comprises a cam plate on said partition feeder and a retractable plunger on said selecting apparatus, said plunger being received within an aperture in said cam plate to engage said partition feeder to said selecting apparatus and being retracted to release said partition feeder from said selecting apparatus.

21. The frame as set forth in claim 17, wherein said engaging means comprises a cam plate on said one beam and a retractable plunger on said partition inserter, said plunger being received within an aperture in said cam plate to engage said partition inserter to said one beam and being retracted to release said partition inserter from said one beam.

22. The frame as set forth in claim 17, wherein said positioning means comprises a motor for rotating a ball screw, a second linear guide placed below and parallel to a length of said ball screw, and a bracket threaded onto said ball screw and travelling along said second linear guide, said partition inserter being mounted to said bracket and having its position along said one beam being determined by a position of said bracket along said ball screw.

23. An apparatus for adjustably suspending a partition inserter above a path along which articles move in an article packaging machine, said apparatus comprising:

a frame;

a guide mounted to said frame above the path, said guide extending in a predetermined direction relative to the path;

mounting means for suspending the partition inserter from said guide for selective movement of the partition inserter along said guide and over the path in said predetermined direction;

the position of the partition inserter being adjustable relative to the path and relative to articles moving therealong by appropriate movement of the partition inserter along said guide.

24. The apparatus of claim 23 and wherein said predetermined direction is substantially perpendicular to the path to provide for selective transverse adjustment of the partition inserter relative to the path.

25. The apparatus of claim 23 and wherein said guide extends substantially horizontally in said predetermined direction for selective horizontal adjustment of the partition inserter relative to the path.

26. The apparatus of claim 25 and further comprising means for adjusting the vertical position of the partition inserter relative to the path.

27. The apparatus of claim 26 and wherein said means for adjusting the vertical position of the partition inserter comprises an inner frame vertically movably mounted to said frame, said guide being mounted to said inner frame for adjustment of the vertical position of said guide and a partition inserter suspended therefrom along with vertical adjustment of said inner frame.

28. The apparatus of claim 25 and wherein said predetermined direction is substantially perpendicular to the path.

29. An apparatus for adjustably mounting a partition inserter relative to a flow of articles in a packaging machine, comprising:

a generally planar rack having a plurality of beams extended transversely across the flow of articles;

a linear guide mounted to at least one of said beams;

means on said partition inserter for movably mounting said partition inserter to said linear guide;

the transverse position of said partition inserter relative to said flow of articles being adjusted by movement of said partition inserter along said linear guide; and engagement means for releasably engaging said partition inserter and means for selectively positioning said engagement means along said one beam for positioning said partition inserter along said linear guide.

30. An apparatus for adjustably mounting a partition inserter in a packaging machine relative to a flow of articles traveling in a downstream direction, said apparatus comprising:

a rack having a plurality of beams extending transversely relative to the flow of articles;

a guide mounted to at least one of said beams on the upstream side thereof for suspending said partition inserter over said flow of articles; and means on said partition inserter for movably mounting said partition inserter to and suspending said partition inserter from said guide, the lateral position of said partition inserter relative to said flow of articles being adjusted by movement of said partition inserter along said guide.

31. The apparatus as set forth in claim 30, further comprising a platform positioned to one side of the flow of articles and beneath at least a portion of said guide, wherein said partition inserter can be moved along said guide to a position overlying said platform for access to said partition inserter from said platform.

32. The apparatus as set forth in claim 30, further comprising a second partition inserter and means for movably suspending said second partition inserter from said rack.

33. The apparatus as set forth in claim 32, further comprising a third partition inserter and means for movably suspending said third partition inserter from said rack.

34. The frame as set forth in claim 30, and further including means for suspending said partition inserter from at least a pair of said beams.

35. The apparatus as set forth in claim 30, further comprising means for selectively adjusting the vertical position of said rack relative to the flow of articles for corresponding vertical adjustment of said partition inserter.

36. The apparatus as set forth in claim 30, wherein said partition inserter includes a partition feeder for holding a stack of partitions and a selecting apparatus for removing a single partition from said partition feeder and placing said single partition between a selected group of said articles in the flow of articles, said partition feeder and said selecting apparatus each being movably suspended from said guide.

37. The apparatus as set forth in claim 36, further comprising coupling means for releasably coupling said partition feeder to said selecting apparatus for selective independent movement of said partition feeder and said selecting apparatus along said guide.

38. The apparatus as set forth in claim 37, wherein said coupling means comprises a cam plate on said partition feeder and a retractable plunger on said selecting apparatus, said plunger being receivable within an aperture in said cam plate to couple said partition feeder to said selecting apparatus and being retractable from said apparatus to decouple said partition feeder from said selecting apparatus.

39. The apparatus as set forth in claim 30, further comprising engaging means for releasably engaging said partition inserter to said one beam and positioning means for positioning said engaging means along said one beam and for thereby positioning said partition inserter along said one beam when said partition inserter is engaged with said engaging means.

40. The apparatus as set forth in claim 34, wherein said positioning means comprises a motor for rotating a ball screw, a second linear guide placed below and parallel to a length of said ball screw, and a bracket threaded onto said ball screw and traveling along said second linear guide, said partition inserter being mounted to said bracket and having its position along said one beam being determined by a position of said bracket along said ball screw.

41. An apparatus for adjustably mounting a partition inserter relative to a flow of articles in a packaging machine, said apparatus comprising:

a rack;

a linear guide mounted to said rack and extending in a lateral direction relative to the flow of articles;

means on said partition inserter for movably mounting said partition inserter to said linear guide;

the lateral position of said partition inserter relative to said flow of articles being adjusted by movement of said partition inserter along said linear guide; and a platform positioned to one side of the flow or articles and beneath at least a portion of said linear guide, said partition inserter being movable along said linear guide to a position above said platform for access to said partition inserter from said platform.

42. An apparatus for adjustably mounting a partition inserter relative to a flow of articles in a packaging machine, comprising:

a rack having at least one beam extending laterally across the flow of articles;

means for movably mounting said partition inserter to said beam for movement therealong;

the lateral position of said partition inserter relative to said flow of articles being adjusted by movement of said partition inserter along said beam;

said partition inserter including a partition feeder for holding a stack of partitions and a selecting apparatus for removing a single partition from said partition feeder, placing said single partition between a selected group of articles in the flow of articles, said partition feeder and said selecting apparatus each being independently movable along said beam; and means for releasably coupling said partition feeder and said selecting apparatus together for coupled movement or for independent movement of said partition feeder and said selecting apparatus along said beam.

* * * * *